US011608660B2

(12) United States Patent
Graute

(10) Patent No.: US 11,608,660 B2
(45) Date of Patent: Mar. 21, 2023

(54) MOTOR VEHICLE LOCK WITH CRASH ELEMENT

(71) Applicant: Brose Schliesssysteme GmbH & Co. KG, Wuppertal (DE)

(72) Inventor: Ludger Graute, Essen (DE)

(73) Assignee: Brose Schliessysteme GmbH & Co. KG, Wuppertal (DE)

( * ) Notice: Subject to any disclaimer, the term of this patent is extended or adjusted under 35 U.S.C. 154(b) by 983 days.

(21) Appl. No.: 16/015,414

(22) Filed: Jun. 22, 2018

(65) Prior Publication Data

US 2018/0371803 A1 Dec. 27, 2018

(30) Foreign Application Priority Data

Jun. 22, 2017 (DE) ..... 10 2017 113 880.3

(51) Int. Cl.
*E05B 77/06* (2014.01)

(52) U.S. Cl.
CPC ..... *E05B 77/06* (2013.01)

(58) Field of Classification Search
CPC ..... E05B 77/06; E05B 77/04; E05B 77/02; Y10S 292/22
See application file for complete search history.

(56) References Cited

U.S. PATENT DOCUMENTS 703,962 A 7/1902 John et al.
846,129 A 3/1907 Clyde et al.
2,793,898 A 5/1957 Roethel et al.
2,832,626 A 4/1958 Priestman et al.
3,848,909 A 11/1974 Foley C et al.
4,441,345 A 4/1984 Guarr
(Continued)

FOREIGN PATENT DOCUMENTS

CN 104420741 3/2015
CN 104847186 8/2015
(Continued)

OTHER PUBLICATIONS

File History for U.S. Appl. No. 13/929,193 downloaded Jun. 25, 2018 (355 pages).
(Continued)

*Primary Examiner* — Kristina R Fulton
*Assistant Examiner* — Noah Horowitz
(74) *Attorney, Agent, or Firm* — Pauly, DeVries Smith & Deffner LLC

(57) ABSTRACT

A motor-vehicle lock has a latch mechanism, catch, has and an actuating lever, of which the actuation from a starting position into an actuating position makes it possible to disengage the catch, wherein the motor-vehicle lock has a crash element, which can be adjusted from a normal state into a crash state, in which the crash element blocks the actuating lever in a blocking position or uncouples it from the catch, wherein the crash element is coupled to the actuating lever such that, when the actuating lever is actuated at an actuating speed above a limit actuating speed, the crash element latches in the crash state. With the crash element latched in the crash state, a restoring action of the actuating lever into the starting position causes the latching action to be reversed and the crash element to be adjusted into the normal state.

18 Claims, 5 Drawing Sheets

(56) References Cited

U.S. PATENT DOCUMENTS

| | | | | |
|---|---|---|---|---|
| 4,911,489 | A | 3/1990 | Hansen et al. | |
| 5,183,300 | A | 2/1993 | Schrader et al. | |
| 5,865,481 | A | 2/1999 | Buschmann | |
| 5,967,572 | A | 10/1999 | Sajfert et al. | |
| 6,308,998 | B1 | 10/2001 | Armbruster et al. | |
| 6,471,259 | B1 | 10/2002 | Erices et al. | |
| 6,543,820 | B2 | 4/2003 | Kelly et al. | |
| 6,971,688 | B2 | 12/2005 | Drysdale et al. | |
| 7,175,211 | B2 | 2/2007 | Cetnar et al. | |
| 7,198,307 | B2 | 4/2007 | Drysdale et al. | |
| 7,325,874 | B2 | 2/2008 | Zhang et al. | |
| 7,607,702 | B2 | 10/2009 | Pereverzev | |
| 7,703,828 | B2 | 4/2010 | O'connor et al. | |
| 7,926,858 | B2 | 4/2011 | Otsuka | |
| 8,056,944 | B2 | 11/2011 | Jankowski et al. | |
| 8,303,004 | B2 | 11/2012 | Lee et al. | |
| 8,727,398 | B2 | 5/2014 | Brose et al. | |
| 8,727,443 | B2 | 5/2014 | Vedder et al. | |
| 8,764,077 | B2 | 7/2014 | Takagi et al. | |
| 8,967,678 | B2 | 3/2015 | Rosales et al. | |
| 9,074,393 | B2 | 7/2015 | Brose et al. | |
| 9,109,380 | B2 | 8/2015 | Mittelbach et al. | |
| 9,163,436 | B2 | 10/2015 | Nagata et al. | |
| 9,341,005 | B2 | 5/2016 | Müller et al. | |
| 9,366,063 | B2 * | 6/2016 | Rosales | E05B 85/26 |
| 9,376,842 | B2 | 6/2016 | Wittelsbuerger et al. | |
| 9,732,544 | B2 | 8/2017 | Wittelsbuerger et al. | |
| 9,874,046 | B2 * | 1/2018 | Wittelsbuerger | E05B 77/06 |
| 10,132,106 | B2 | 11/2018 | Rosales | |
| 2006/0267351 | A1 | 11/2006 | Spurr | |
| 2009/0322105 | A1 | 12/2009 | Lee et al. | |
| 2010/0237633 | A1 | 9/2010 | Jankowski et al. | |
| 2010/0283268 | A1 | 11/2010 | Cumbo | |
| 2011/0084505 | A1 | 4/2011 | Brose et al. | |
| 2011/0181052 | A1 | 7/2011 | Brose et al. | |
| 2011/0252844 | A1 | 10/2011 | Shoemaker | |
| 2011/0254343 | A1 | 10/2011 | Vedder et al. | |
| 2013/0129413 | A1 | 5/2013 | Dryburgh et al. | |
| 2013/0147209 | A1 | 6/2013 | Lee et al. | |
| 2013/0147211 | A1 | 6/2013 | Lee et al. | |
| 2013/0313036 | A1 | 11/2013 | Kovie | |
| 2013/0328325 | A1 | 12/2013 | Uehara et al. | |
| 2014/0097624 | A1 | 4/2014 | Papanikolaou et al. | |
| 2014/0132008 | A1 | 5/2014 | Bendel et al. | |
| 2014/0284939 | A1 * | 9/2014 | Wittelsbuerger | E05B 77/06 292/92 |
| 2014/0284942 | A1 | 9/2014 | Wittelsbuerger et al. | |
| 2014/0284943 | A1 | 9/2014 | Wittelsbuerger et al. | |
| 2014/0284944 | A1 | 9/2014 | Rosales et al. | |
| 2014/0284945 | A1 | 9/2014 | Wittelsbuerger et al. | |
| 2014/0346786 | A1 | 11/2014 | Takagi et al. | |
| 2015/0061301 | A1 | 3/2015 | Torka et al. | |
| 2015/0115628 | A1 | 4/2015 | Wittelsbuerger et al. | |
| 2016/0010363 | A1 * | 1/2016 | Wahmann | E05B 77/06 292/92 |
| 2016/0090759 | A1 | 3/2016 | Rosales et al. | |
| 2017/0114574 | A1 * | 4/2017 | Topfer | E05B 77/38 |
| 2020/0056404 | A1 * | 2/2020 | Fuchs | E05B 77/12 |

FOREIGN PATENT DOCUMENTS

| | | |
|---|---|---|
| DE | 19511651 | 10/1995 |
| DE | 19624640 | 1/1998 |
| DE | 10337392 | 3/2005 |
| DE | 10345104 | 4/2005 |
| DE | 102004014550 | 10/2005 |
| DE | 202009009060 | 1/2011 |
| DE | 202009009061 | 1/2011 |
| DE | 102011010815 | 8/2012 |
| DE | 112010004028 | 1/2013 |
| DE | 102014004552 | 10/2015 |
| EP | 1018589 | 7/2000 |
| EP | 1518983 | 3/2005 |
| EP | 2133495 | 12/2009 |
| EP | 2339098 | 6/2011 |
| WO | 2011010554 | 1/2011 |
| WO | 2011110142 | 9/2011 |
| WO | 2012055387 | 5/2012 |
| WO | 2012119580 | 9/2012 |
| WO | 2012124069 | 9/2012 |
| WO | 2013046317 | 4/2013 |
| WO | 2017036452 | 3/2017 |

OTHER PUBLICATIONS

File History for U.S. Appl. No. 13/929,258 downloaded Jun. 25, 2018 (120 pages).
File History for U.S. Appl. No. 13/941,254 downloaded Jun. 25, 2018 (237 pages).
File History for U.S. Appl. No. 13/929,265 mailed Jun. 25, 2018 (120 pages).
File History for U.S. Appl. No. 13/929,278 downloaded Jun. 25, 2018 (182 pages).
File History for U.S. Appl. No. 14/065,124 downloaded Jun. 26, 2018 (140 pages).
File History for U.S. Appl. No. 14/871,601 downloaded Jun. 25, 2018 (175 pages).
German Search Report for DE 10 2014 104 111.9, dated Dec. 1, 2014 (7 pages).
German Search Report for DE application No. 102014104120.8 dated Mar. 13, 2015 (5 pages).
German Search Report for German Priority Application No. DE102017113880.3 dated Feb. 28, 2018 (8 pages).
Search Report for German Patent Application No. 102014104118.6 related to U.S. Appl. No. 13/929,258, dated Dec. 9, 2014 (7 pages).
Takagi, et al., "Vehicle Door Lock," from WO2011010554, Takagi et al., with English translation. Translated on Mar. 23, 2015 (15 pages).
Search Report for Chinese Patent Application No. 201810651801.2 dated Jan. 17, 2020 (3 pages).

* cited by examiner

MOTOR VEHICLE LOCK WITH CRASH ELEMENT

CLAIM OF PRIORITY

This application claims the benefit of German Patent application No. DE 10 2017 113 880.3 filed on Jun. 22, 2017, the disclosure of which is incorporated herein by reference.

FIELD OF THE TECHNOLOGY

The disclosure relates to a motor-vehicle lock.

BACKGROUND

The term "motor-vehicle lock" here combines all kinds of locks for doors, hoods or flaps.

The crash safety of the motor-vehicle lock in question is of particular importance. High crash accelerations occur in the event of a crash, and these accelerations can result in the undesired opening of the motor-vehicle lock. In the case in hand here, the crash accelerations give rise to automatic disengagement of a door handle, and this is accompanied by the risk of vehicle occupants being thrown out. The avoidance of such undesired, crash-induced actuation of a door handle is paramount here.

The known motor-vehicle lock (EP 2 339 098 A2), from which the disclosure proceeds discloses, in one variant, a mechanism for avoiding the undesired, crash-induced actuation of a door handle. This prior art provides a crash element which, when actuated at excessive actuating speed, as would be expected in the event of a crash, latches in a crash state. In this crash state, the crash element blocks an actuating lever, which is coupled to the door handle, and therefore undesired, crash-induced actuation of the door handle does not take place.

The latching action of the crash element in the crash state is advantageous insofar as crash accelerations often occur as a sequence comprising a multiplicity of individual accelerations which differ in terms of direction and intensity. It may therefore be the case that two crash accelerations follow immediately one after the other. The above latching action avoids the situation, in the case of the known motor-vehicle lock, where the subsequent crash accelerations trigger undesired actuation of the door handle.

It is worth mentioning, in the case of the known motor-vehicle lock, that, as far as the variant in question here is concerned, the blocking action of the actuating lever is triggered exclusively by an excessive actuating speed of the actuating lever, which is attributable to a correspondingly excessive actuating speed of the door handle. It is this which renders this particular crash mechanism operative, to be precise irrespective of the direction of the respective crash accelerations.

With the design of the known motor-vehicle lock, it is a challenge to provide so that the specific reversal of the latching action, once the crash accelerations have occurred, it is possible for the motor-vehicle lock to be opened again without the crash safety being adversely affected. In the case of the known motor-vehicle lock, the latching action is reversed only by an interior door handle being actuated, and this adversely affects the operability of the motor-vehicle lock in the event of a crash.

SUMMARY

The disclosure addresses the problem of increasing operability in the event of a crash, while maintaining a high level of crash safety.

The above problem is solved, in the case of a motor-vehicle lock as described herein.

An essential factor is the basic consideration that, in the case of a suitable design, the reversal of the latching action can take place, in particular automatically, in response to the actuating lever being restored, the operability of the motor-vehicle lock being fully re-established once the latching action has been reversed.

According to the proposal, it is assumed in the first instance that the actuating lever, which is coupled to a door handle, can be adjusted between a starting position and an actuating position. Provision can be made here for the actuating lever to be spring-prestressed into the starting position.

Specifically, then, it is proposed that, with the crash element latched in the crash state, a restoring action of the actuating lever into the starting position causes the latching action to be reversed and the crash element to be adjusted into the normal state. This means that the latching action of the crash element in the crash state is present only over a relatively short period of time as the actuating lever is being restored. This is based on the finding that the crash accelerations in question here follow one after the other in quick succession, and therefore even just a very brief latching action is sufficient to maintain the crash safety. Furthermore, any crash accelerations which follow can then trigger a renewed latching action of the crash element in the crash state.

The solution according to the proposal ensures not just a high level of crash safety, but also a high level of operability of the motor-vehicle lock in the event of a crash. The reversal of the latching action according to the proposal means that the user will not even be aware of the existence of the crash mechanism.

Various embodiment clarify that the reversal of the latching action takes place only when the actuating lever is restored fully into the starting position. Depending on the application, however, provision may also be made for the reversal of the latching action to be triggered while the actuating lever is being restored between the blocking position and the starting position.

Various embodiments relate to a switchable coupling, which serves for blocking and uncoupling the actuating lever. It is advantageous here that such a switchable coupling, depending on the application, can be realized in a straightforward manner in terms of design. A particularly robust configuration of the coupling is in that the coupling is realized in the form of a guide-track coupling with a coupling element configured in the form of a guide track and a coupling element configured in the form of a sliding block.

In some embodiments, the latching action of the crash element in the crash state is attributable to a latching action of the coupling. The coupling thus performs a double function, that is to say, on the one hand, it blocks and uncouples the actuating lever and, on the other hand, it latches the crash element in the crash state. This results in an arrangement which is particularly compact, and is of robust design, overall.

Various embodiments provide a motor-vehicle lock having a latch mechanism and catch, as locking elements, wherein the motor-vehicle lock has an actuating lever, which can be pivoted about an actuating-lever axis and of which the actuation from a starting position into an actuating position makes it possible to disengage the catch, wherein the motor-vehicle lock has a crash element, which can be adjusted from a normal state into a crash state, in which the crash element blocks the actuating lever in a blocking position or uncouples it from the catch, wherein the crash element is coupled to the actuating lever such that, when the actuating lever is actuated at an actuating speed above a limit actuating speed, the crash element latches in the crash state, wherein with the crash element latched in the crash state, a restoring action of the actuating lever into the starting position causes the latching action to be reversed and the crash element to be adjusted into the normal state.

In various embodiments, with the crash element latched in the crash state, it is only the actuating lever being restored by at least 80% into the starting position, as seen in relation to the movement region between the starting position and actuating position, such as it is only the actuating lever being restored fully into the starting position, which causes the latching action to be reversed and the crash element to be adjusted into the normal state.

In various embodiments, actuation of the actuating lever at an actuating speed above the limit actuating speed as a result of the inertia of the crash element causes the crash element to be adjusted into the crash state.

In various embodiments, the crash element is spring-prestressed into the normal state.

In various embodiments, a crash-element bearing means mounts the crash element on the actuating lever such that it can be pivoted about a crash-element axis, which can be arranged at a distance from the actuating-lever axis, such as wherein the crash-element axis can be displaced on the actuating lever, and wherein the adjustment of the crash element between the normal state and the crash state is attributable to a displacement of the crash-element axis on the actuating lever.

In various embodiments, the crash element can be pivoted out of a starting position about the crash-element axis, and wherein the crash element is spring-prestressed into the starting position.

In various embodiments, a switchable coupling, in particular a guide-track coupling, is provided between the actuating lever and the crash element and, in dependence on the state of the crash element, is switched into a coupled state or into an uncoupled state.

In various embodiments, the coupling has two coupling elements, which are provided by the activating lever, on the one hand, and by the crash element, on the other hand, and, in dependence on the coupling state, engage with one another, such as wherein one of the coupling elements is designed in the form of a guide track and the other of the coupling elements is designed in the form of a sliding block.

In various embodiments, in the coupled state, the coupling establishes a drive-function coupling between the actuating lever and the crash element in respect of a pivoting movement of the crash element about the crash-element axis.

In various embodiments, a blocking stop, which is in a fixed position relative to the actuating lever, is provided, the crash element coming into abutment therewith when the actuating lever is actuated.

In various embodiments, with the crash element located in the crash state, actuation of the actuating lever is blocked via the coupling, the crash element and the blocking stop, and/or wherein, with the crash element located in the normal state, actuation of the actuating lever is accompanied by a compensating movement of the crash element in relation to the actuating lever.

In various embodiments, with the crash element located in the crash state, the actuating lever has been separated in drive-function terms from the catch by means of the coupling, and/or wherein, with the crash element located in the normal state, the actuating lever can be coupled in drive-function terms to the catch by means of the coupling.

In various embodiments, the latching action of the crash element in the crash state is attributable to a latching action of the coupling, and wherein, with the crash element located in the crash state, the coupling elements of the coupling are latched to one another, such as wherein one of the coupling elements has an undercut, the other one of the coupling elements engaging behind said undercut in order for the two coupling elements to be latched to one another.

In various embodiments, the crash element can be adjusted into the crash state by an accelerating action which occurs in the event of a crash and acts on the motor-vehicle lock.

BRIEF DESCRIPTION OF THE DRAWINGS

The disclosure will be explained in more detail herein below with reference to a drawing, which illustrates just an exemplary embodiment and in which.

DETAILED DESCRIPTION

Figure 1:
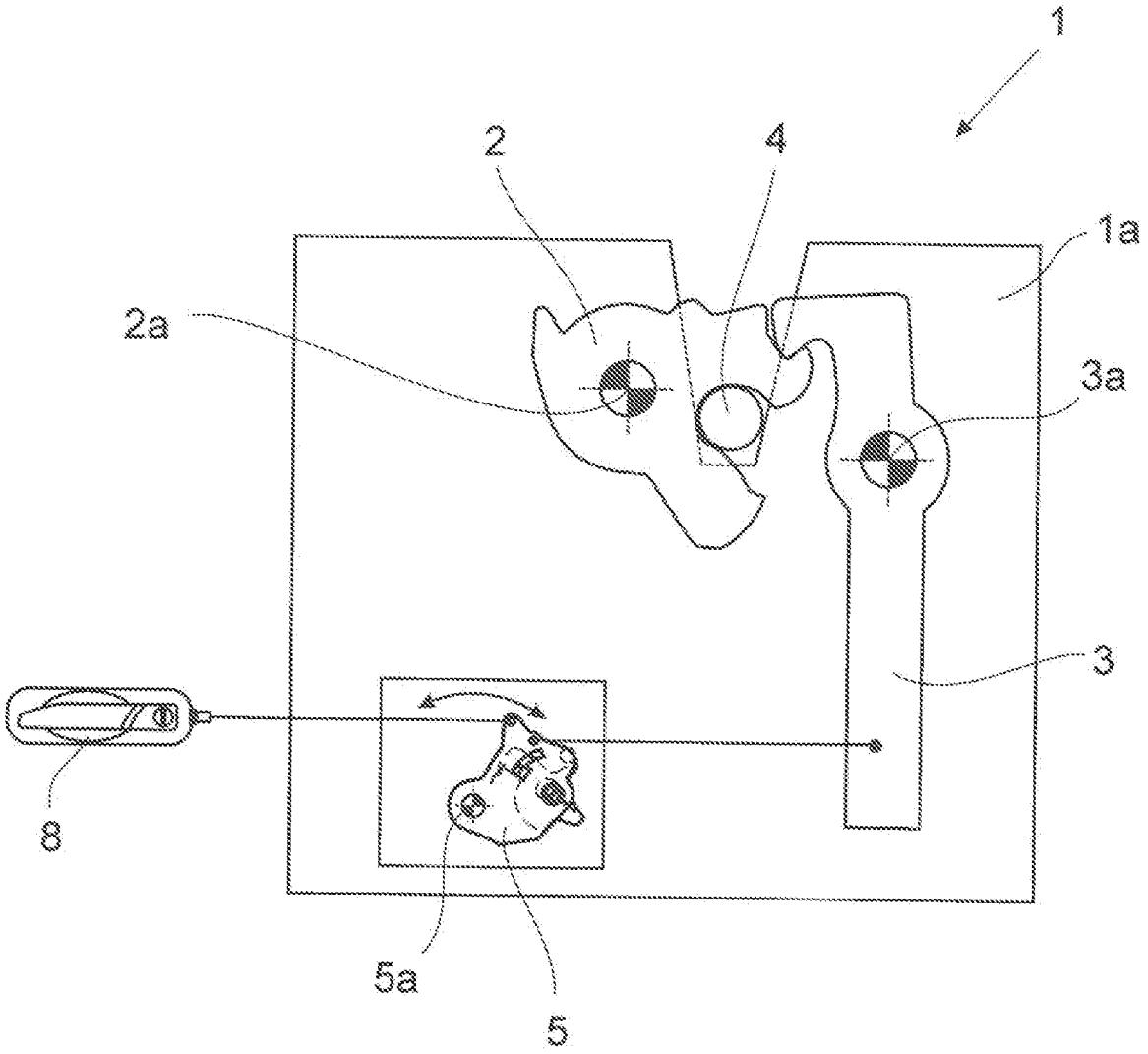
FIG. 1 shows an entirely schematic illustration of a motor-vehicle lock according to the proposal.

It should be pointed out in the first instance that the drawing illustrates only those components of a motor-vehicle lock 1 according to the proposal which are necessary for explaining the teaching. For example, there is no lock mechanism illustrated to provide for the setting of different locking states such as "locked" and "unlocked". It is also the case that there is no internal door handle illustrated here. Everything which is said herein below applies correspondingly to motor-vehicle locks which have such components not illustrated here.

FIG. 1 shows that the motor-vehicle lock 1 has a lock housing 1*a* and, contained within the same, the locking elements constituted by a latch mechanism 2 and catch 3, which interact with one another in the conventional manner. The latch mechanism 2 can be moved into the main locking position, which is shown in FIG. 1 and in which it is retained by the catch 3. The latch mechanism 2 here is retained in engagement with a locking part 4, which is configured in this case in the form of a striker pin. The catch 3 here can be pivoted, in FIG. 1 in the clockwise direction, about a catch axis 3*a*, in which case the latch mechanism 2 is freed and can pivot, in FIG. 1 in the counterclockwise direction, about a latch-mechanism axis 2*a* in the opening direction.

It is then the case that the locking part 4 is in the freed state and the motor-vehicle door or the like assigned to the motor-vehicle lock 1 can be opened.

The motor-vehicle lock 1 according to the proposal has at least one actuating lever 5, which can be pivoted about an actuating-lever axis 5*a* and of which the actuation out of a starting position into an actuating position makes it possible to disengage the catch 3. The starting position is shown in FIG. 2*a*, whereas the actuating position is shown in FIG. 2*b*. Depending on the configuration of the motor-vehicle lock 1, the disengageability of the catch 3 depends not just on the actuation of the actuating lever 5, but also on the locking state of any lock mechanism provided. This has no significance, however, as far as the solution according to the proposal is concerned.

The actuating lever 5 is coupled in this case to a door handle 8, in particular an exterior door handle. It is basically also possible, however, for the door handle to be an interior door handle or some other door handle. In FIGS. 2 to 5, the drive train to the door handle is indicated by the reference sign A, whereas the drive train to the catch 3 is indicated by the reference sign B.

The motor-vehicle lock 1 is also equipped with a crash element 6, which can be adjusted, in a manner which is yet to be explained, out of a normal state into a crash state. The normal state of the crash element 6 is shown in FIG. 2*a*, whereas the crash state of the crash element 6 is shown in FIG. 3*a*.

Figure 2:
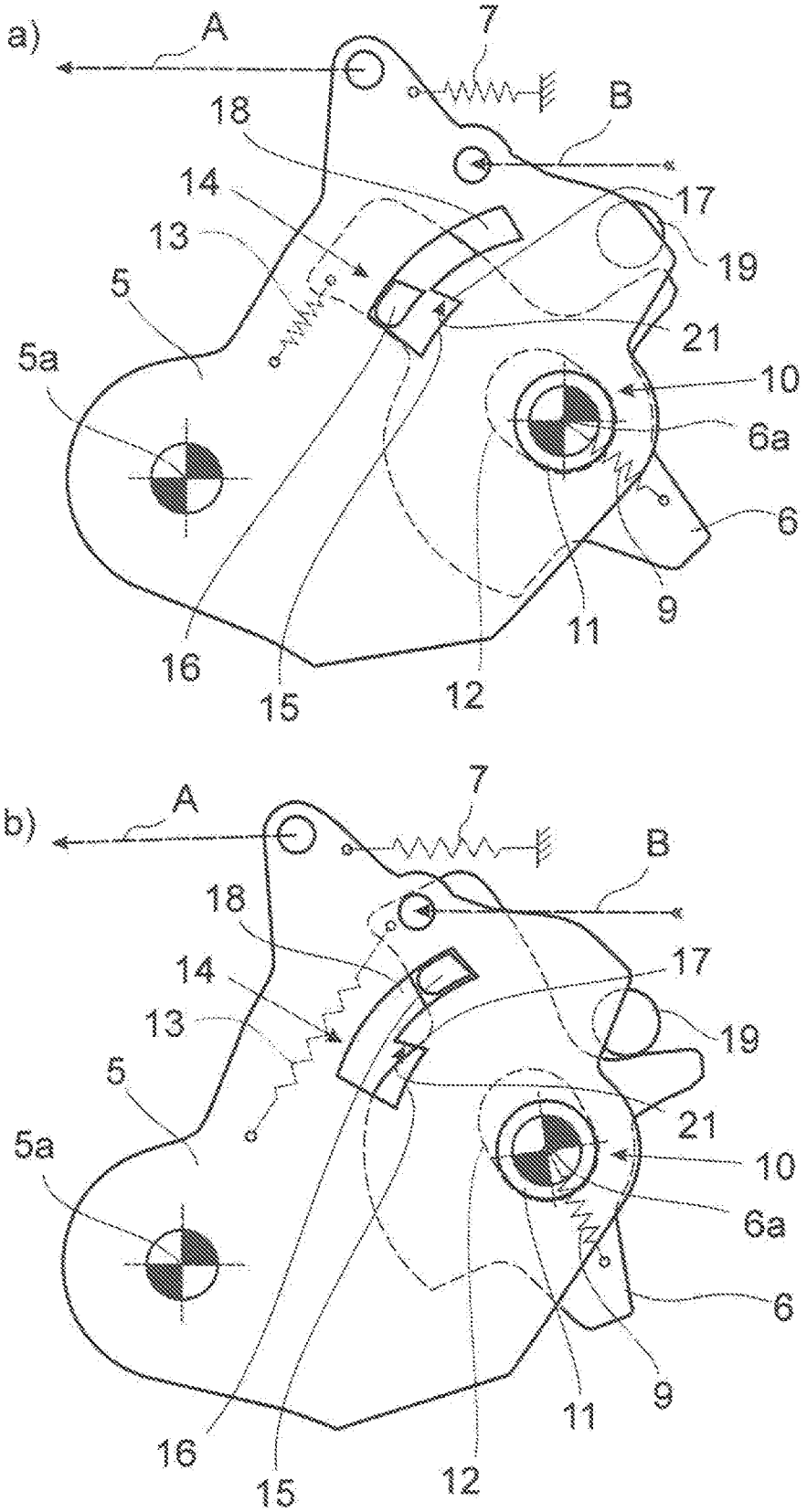
FIG. 2 shows the arrangement made up of the actuating lever and crash element of the motor-vehicle lock according to FIG. 1 in the normal state, a) with the actuating lever in an unactuated state, and b) with the actuating lever actuated manually.
Figure 3:
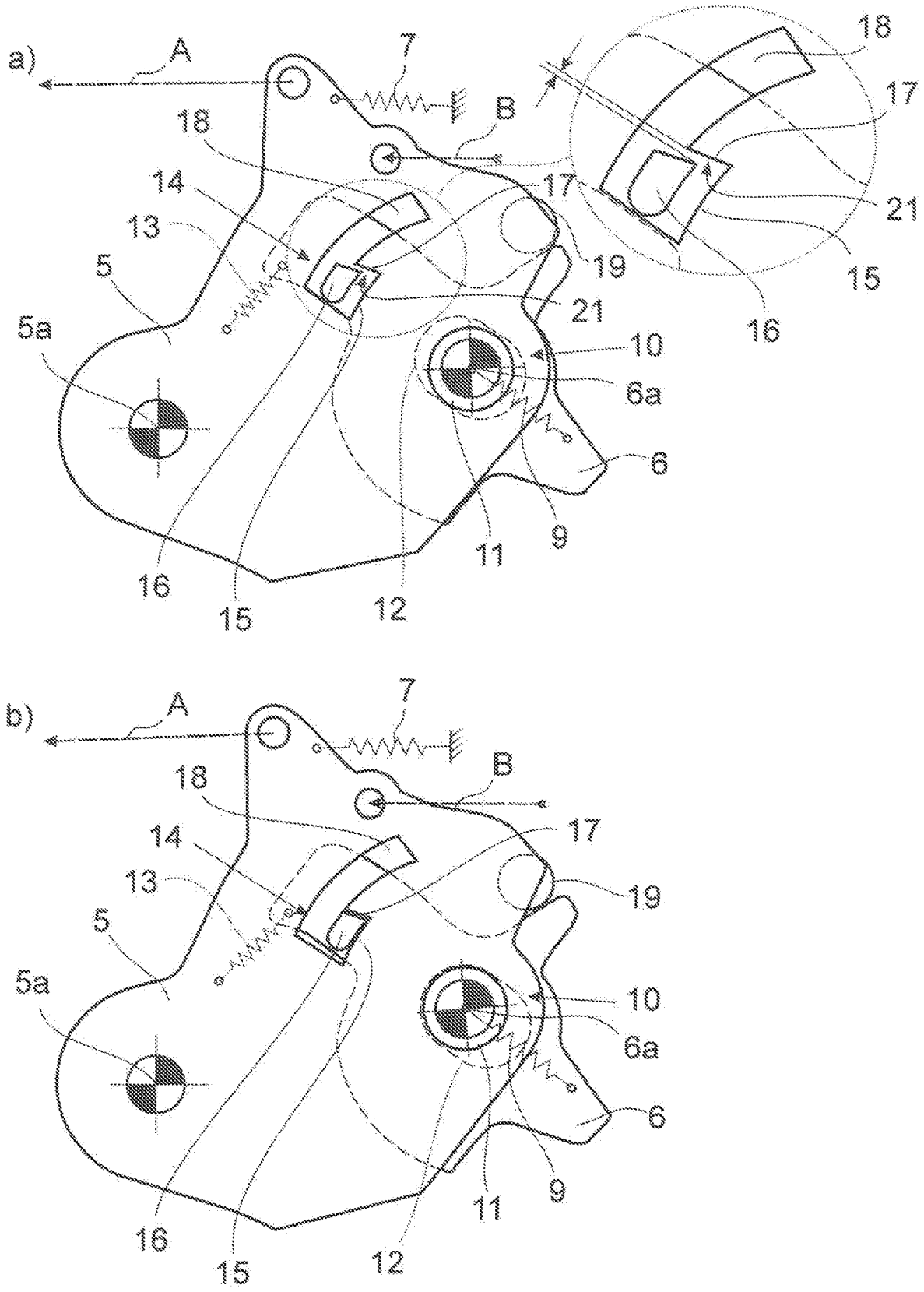
FIG. 3 shows the arrangement according to FIG. 2 in the event of a crash, a) during the crash-induced adjustment of the crash element from the starting state in the direction of the crash state, and b) following crash-induced latching action of the crash element in the crash state.
Figure 4:
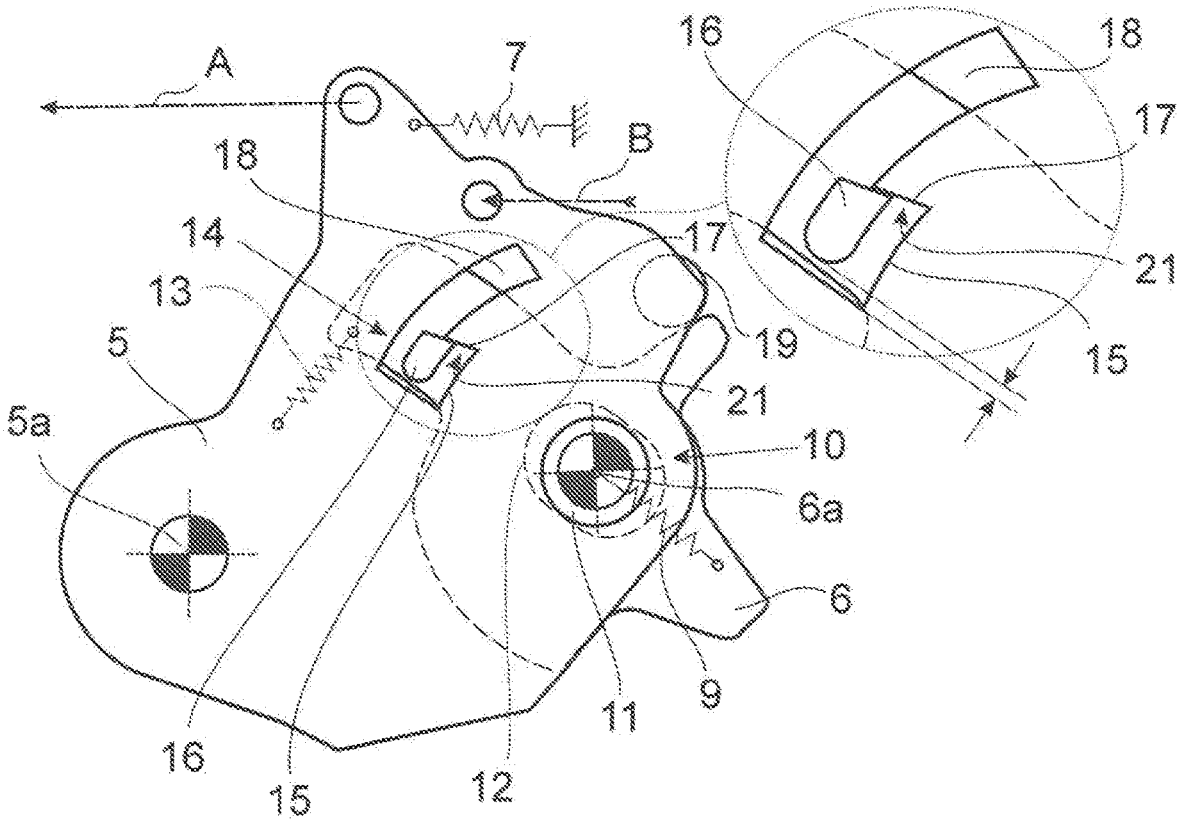
FIG. 4 shows the arrangement according to FIG. 2 during the operation of restoring the actuating lever actuated by the crash.

In the crash state, depending on the configuration, the crash element 6 also influences the motor-vehicle lock 1 in different ways. In the case of the configuration which is shown in FIGS. 2 to 4, the crash element 6 located in the crash state blocks the actuating lever 5 in a blocking position, as is shown in FIG. 3*b*. In the case of the configuration according to FIG. 5, in contrast, provision is made for the crash element 6 located in the crash state to uncouple the actuating lever 5 from the catch 3, and therefore, with the crash element 6 located in the crash state, the actuating lever 5 freewheels.

In the case of both embodiments, when the actuating lever 5 is actuated at an excessive actuating speed, the crash element 6 latches in the crash state. The latched crash state is shown, for the first-mentioned exemplary embodiment, in FIG. 3*b*. The term "latched" here means that the crash element 6 remains in the crash state in the first instance, even when the actuating lever 5 is no longer being actuated at excessive actuating speeds. It is only when the latching action is reversed that the crash element 6 can return to the normal state.

It is essential, then, that, with the crash element 6 latched in the crash state, a restoring action of the actuating lever 5 into the starting position causes the latching action to be reversed and the crash element 6 to be adjusted into the normal state. The restoring action of the actuating lever 5 is shown in the drawing by the transition from FIG. 4 to FIG. 2*a*. This automatic reversal of the latching action is advantageous, in particular, since the user is unaware of the crash element 6 functioning, and therefore full operability is achieved even in the event of a crash.

The actuating lever 5 is spring-prestressed into its starting position in this case by means of a spring element 7, and therefore the actuating lever 5 is always restored automatically.

Figure 5:
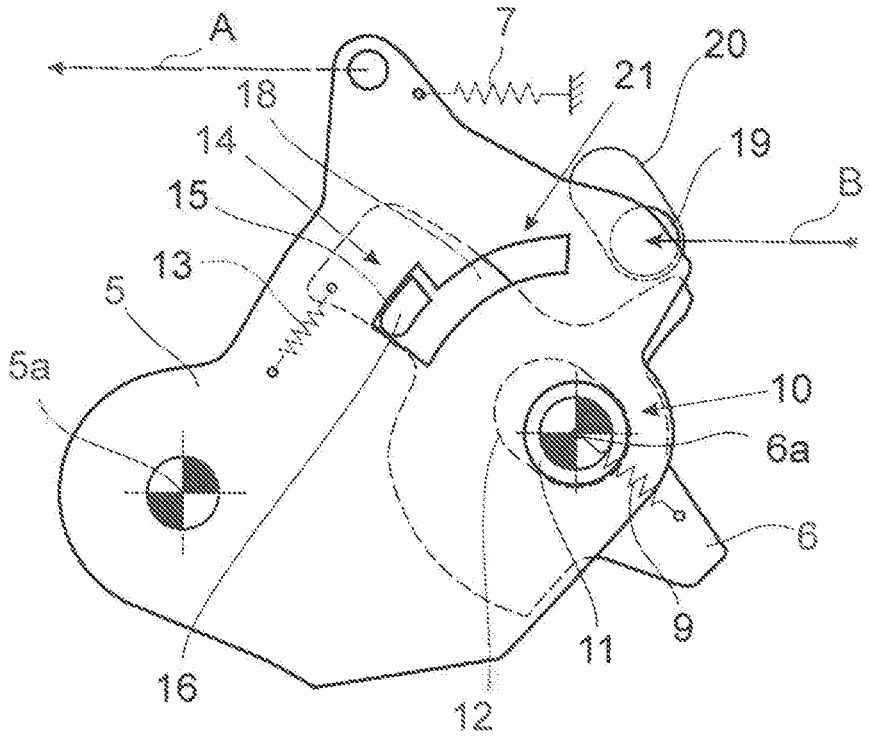
FIG. 5 shows a further embodiment of the arrangement according to FIG. 2 in the normal state.

Provision may be made, in principle, that, with the crash element 6 latched in the crash state, it is only the actuating lever 5 being restored by at least 80% into the starting position, as seen in relation to the movement region between the starting position and actuating position, here only the actuating lever 5 being restored fully into the starting position, that causes the latching action to be reversed and the crash element 6 to be adjusted into the normal state. This means that, following crash-induced actuation of the actuating lever 5, the actuating lever 5 is restored by a certain distance without the latching action being reversed. Therefore, if there is renewed, crash-induced actuation during this restoring action, the crash element 6 remains in the crash state, and therefore the actuating lever 5 is still blocked (FIGS. 2 to 4) or in a freewheeling state (FIG. 5). In this case, with the crash element 6 latched in the crash state, it is only the actuating lever 5 being restored fully into the starting position which causes the latching action to be reversed and the crash element 6 to be adjusted into the normal state.

Various options are conceivable for adjusting the crash element 6 according to the proposal in dependence on the actuating speed of the actuating lever 5. In the case of the exemplary embodiment illustrated, actuation of the actuating lever 5 at an actuating speed above a limit actuating speed as a result of the inertia of the crash element 6 causes the crash element 6 to be adjusted into the crash state. This is shown by the transition from FIG. 2*a* to FIG. 3*a*. It should be stated here in the first instance that the crash element 6 is spring-prestressed into the normal state. For this purpose, the crash element 6 is assigned a first spring element 9.

The adjustability of the crash element 6 between the starting state (FIG. 2*a*) and the crash state (FIG. 3*b*) is achieved in this case by a specific bearing means of the crash element 6. In a first instance, it can be the case that a crash-element bearing means or member 10 mounts the crash element 6 on the actuating lever 5 such that it can be pivoted about a crash-element axis 6*a*, which can be arranged at a distance from the actuating-lever axis 5*a*. It should be emphasized here that the crash-element axis 6*a* can be displaced on the actuating lever 5, wherein the adjustment of the crash element 6 between the normal state and the crash state is attributable to a displacement of the crash-element axis 6*a* on the actuating lever 5. In various embodiments, this adjustability of the crash-element axis 6*a* on the actuating lever 5 is linear. In the simplest case, the crash-element bearing member 10 is produced by a bearing pin 11 engaging with a slot 12. In this case the bearing pin 11 is arranged on the actuating lever 5, whereas the slot 12 is arranged on the crash element 6.

In the case of the exemplary embodiments illustrated, the crash element 6 can be pivoted, in this case, in relation to the actuating lever 5, out of a starting position (FIG. 2*a*) about the crash-element axis 6*a*, wherein the crash element 6 is spring-prestressed into the starting position. For this purpose, the crash element is equipped with a second spring element 13.

It can be the case that a switchable coupling 14 is switched by the adjustment of the crash element 6 between the normal state and the crash state. The coupling 14 is provided between the actuating lever 5 and the crash element 6. In dependence on the state of the crash element 6, it is switched into a coupled state or into an uncoupled state. In this case, the coupling 14 is a guide-track coupling, as will be explained in more detail herein below.

In the case of the exemplary embodiment shown in FIGS. 2 to 4, the arrangement is such that, in the normal state of the crash element 6, the coupling 14 is in the uncoupled state and, in the crash state of the crash element 6, the coupling 14 is in the coupled state. This is the other way round in the case of the exemplary embodiment which is shown in FIG. 5.

Specifically, the coupling 14 can include two coupling elements 15, 16, which are provided by the actuating lever 5, on the one hand, and by the crash element 6, on the other hand, and, in dependence on the coupling state, engage with one another. One of the coupling elements 15, 16, in this case the coupling element 15, which is provided by the actuating lever 5, is designed in the form of a guide track and the other one of the coupling elements 15, 16, in this case the coupling element 16, which is provided by the crash element 6, is designed in the form of a sliding block, which runs in the guide track. Such a guide-track coupling is a particularly robust and cost-effective way of realizing the coupling 14.

A look at FIG. 2*a* and FIG. 2*b* together shows that, with the crash element 6 located in the normal state, the coupling 14 there is in the uncoupled state, and therefore the actuating lever 5 and the crash element 6 can be pivoted freely in relation to one another over a movement region. With the crash element 6 located in the crash state, that is to say with the coupling 14 located in the coupled state, the coupling then establishes a drive-function coupling between the actuating lever 5 and the crash element 6 in respect of a pivoting movement of the crash element 6 about the crash-element axis 6*a*. This is shown specifically in FIG. 3*b*. It becomes clear here that the coupling element 15, which is configured in the form of a guide track, has a driver guide-track portion 17, which in the coupled state engages with the coupling element 16, which is configured in the form of a sliding block. In the uncoupled state, in contrast, the coupling element 16, which is configured in the form of a sliding block, runs in a freewheel guide-track portion 18, the coupling 14 not establishing any interaction between the actuating lever 5 and the crash element 6.

In the case of the exemplary embodiment shown in FIGS. 2 to 4, a blocking stop 19, which is in a fixed position relative to the actuating lever 5, is provided, the crash element 6 coming into abutment therewith, when the actuating lever 5 is actuated. This is shown in FIG. 2*b* and FIG. 3*b*. When the actuating lever 5 is actuated in the counter-clockwise direction about the actuating-lever axis 5*a* in FIGS. 2 and 3, this means that the crash element 6 pivots in the clockwise direction about the crash-element axis 6*a*, as long as this is not prevented by the coupling 14.

As a result, in the case of the exemplary embodiment shown in FIGS. 2 to 4, with the crash element 6 located in the crash state, actuation of the actuating lever 5 is blocked via the coupling 14, the crash element 6 and the blocking stop 19, as is shown in FIG. 3*b*. With the crash element 6 located in the normal state, in contrast, provision can be made for actuation of the actuating lever 5 to be accompanied by a compensating movement of the crash element 6 in relation to the actuating lever 5.

The compensating movement can be gathered in the transition from FIG. 2*a* to FIG. 2*b*.

Whereas the exemplary embodiment illustrated in FIGS. 2 to 4 is directed toward the actuating lever 5 being blocked when the crash element 6 is located in the crash state, the exemplary embodiment illustrated in FIG. 5 involves the crash element 6 located in the crash state resulting in the actuating lever 5 being uncoupled from the catch 3, and therefore, with the crash element 6 located in the crash state, the actuating lever 5 freewheels.

Specifically, in the case of the exemplary embodiment illustrated in FIG. 5, provision is made so that, with the crash element 6 located in the crash state, the actuating lever 5 has been separated in drive-function terms from the catch 3 by means of the coupling 14. With the crash element 6 located in the normal state, in contrast, provision can be made for it to be possible for the actuating lever 5 to be coupled in drive-function terms to the catch 3 by means of the coupling 14. Proceeding from the exemplary embodiment illustrated in FIGS. 2 to 4, this is achieved for the exemplary embodiment illustrated in FIG. 5 as a result of the coupling element 15, which is configured in the form of a guide track, being rearranged. It is also the case that the blocking stop 19 is guided here in a longitudinal guide 20, which can be fixed to the housing. With the crash element 6 located in the normal state, the driver guide-track portion 17 ensures that the coupling element 16, which is configured in the form of a sliding block, is carried along, and therefore the blocking stop 19 runs in the longitudinal guide 20. Since the drive train B, which runs to the catch 3, is coupled here to the blocking stop 19, the catch 3 can thus be disengaged. In the event of a crash, in contrast, the crash element 6, as explained in conjunction with FIGS. 2 to 4, is transferred into the crash state, and therefore the coupling element 16, which is configured in the form of a sliding block, runs in the freewheel guide-track portion 18. With the crash element 6 located in the crash state, the actuating lever 5 thus freewheels. As long as the actuating lever 5 has not yet been restored into its starting position, the crash element 6 is latched in the crash state, in the above sense, as a result of the interaction of the freewheel guide-track portion 18 with the coupling element 16, which is configured in the form of a sliding block.

In the case of both exemplary embodiments illustrated, provision is made for the latching action of the crash element 6 in the crash state to be attributable to a latching action of the coupling 14. Specifically, with the crash element 6 located in the crash state, the coupling elements 15, 16 of the coupling 14 are latched to one another. It can be, for this purpose, for one of the coupling elements 15, in this case the coupling element 15 configured in the form of a guide track, to have an undercut 21, the other one of the coupling elements 15, 16, in this case the coupling element 16 configured in the form of a sliding block, engaging behind said undercut in order for the two coupling elements 15, 16 to be latched to one another. In the case of the exemplary embodiment illustrated in FIGS. 2 to 4, the undercut 21 is located on the driver guide-track portion 17, whereas, in the case of the exemplary embodiment illustrated in FIG. 5, the undercut 21 is provided by the freewheel guide-track portion 18.

Finally, it should also be pointed out that, according to the proposal, the crash element 6 is adjusted into the crash state by an excessive actuating speed of the actuating lever 5. In addition, provision may nevertheless also be made for the crash element 6 to be adjusted into the crash state by an accelerating action which occurs in the event of a crash and acts on the motor-vehicle lock 1. For the case where the motor-vehicle lock 1 is assigned to a side door of a motor vehicle, provision may be made, for example, for the crash-element bearing member 10 to be oriented such that a side impact on the side door results in inertia-induced adjustment of the crash element 6 from the normal state into the crash state. The crash element 6 here is adjusted relative to the actuating lever 5. This design further increases the crash safety of the motor-vehicle lock 1.

The invention claimed is:

1. A motor-vehicle lock comprising a latch mechanism and catch, as locking elements, wherein the motor-vehicle lock has an actuating lever, which can be pivoted about an actuating-lever axis and of which the actuation from a starting position into an actuating position makes it possible to disengage the catch, wherein the motor-vehicle lock has a crash element, which can be adjusted from a normal state into a crash state, in which the crash element blocks the actuating lever in a blocking position or uncouples it from the catch, wherein the crash element is coupled to the actuating lever such that, when the actuating lever is actuated at an actuating speed above a limit actuating speed, the crash element latches in the crash state, wherein with the crash element latched in the crash state, a restoring action of the actuating lever into the starting position causes the latching action to be reversed and the crash element to be adjusted into the normal state;

the motor-vehicle lock further comprising a switchable coupling between the actuating lever and the crash element, wherein in dependence on the state of the crash element, the switchable coupling is switched into a coupled state or into an uncoupled state, and wherein the switchable coupling comprises two coupling elements, which are provided by the actuating lever, on the one hand, and by the crash element, on the other hand, and, in dependence on the coupling state, engage with one another, wherein in the coupled state the coupling elements are directly engaged with each other, and wherein in the uncoupled state the coupling elements are disengaged from each other so that the switchable coupling does not establish any interaction between the actuating lever and the crash element.

2. The motor-vehicle lock as claimed in claim 1, wherein, with the crash element latched in the crash state, it is only the actuating lever being restored by at least 80% into the starting position, as seen in relation to the movement region between the starting position and actuating position, which causes the latching action to be reversed and the crash element to be adjusted into the normal state.

3. The motor-vehicle lock as claimed in claim 1, wherein actuation of the actuating lever at an actuating speed above the limit actuating speed as a result of the inertia of the crash element causes the crash element to be adjusted into the crash state.

4. The motor-vehicle lock as claimed in claim 1, wherein the crash element is spring-prestressed into the normal state.

5. The motor-vehicle lock as claimed in claim 1, wherein a crash-element bearing member mounts the crash element on the actuating lever such that the crash element can be pivoted about a crash-element axis.

6. The motor-vehicle lock as claimed in claim 5, wherein the crash element can be pivoted out of a starting position about the crash-element axis, and wherein the crash element is spring-prestressed into the starting position.

7. The motor-vehicle lock as claimed in claim 1, wherein, in the coupled state, the switchable coupling establishes a drive-function coupling between the actuating lever and the crash element in respect of a pivoting movement of the crash element about the crash-element axis.

8. The motor-vehicle lock as claimed in claim 1, further comprising a blocking stop, which is in a fixed position relative to the actuating lever, the crash element coming into abutment therewith when the actuating lever is actuated.

9. The motor-vehicle lock as claimed in claim 8, wherein, with the crash element located in the crash state, actuation of the actuating lever is blocked via the switchable coupling, the crash element and the blocking stop, and/or wherein, with the crash element located in the normal state, actuation of the actuating lever is accompanied by a compensating movement of the crash element in relation to the actuating lever.

10. The motor-vehicle lock as claimed in claim 1, wherein, with the crash element located in the crash state, the actuating lever has been separated in drive-function terms from the catch by the switchable coupling, and/or wherein, with the crash element located in the normal state, the actuating lever can be coupled in drive-function terms to the catch by the switchable coupling.

11. The motor-vehicle lock as claimed in claim 1, wherein the latching action of the crash element in the crash state is attributable to a latching action of the switchable coupling, and wherein, with the crash element located in the crash state, the coupling elements of the switchable coupling are latched to one another.

12. The motor-vehicle lock as claimed in claim 1, wherein the crash element can be adjusted into the crash state by an accelerating action which occurs in the event of a crash and acts on the motor-vehicle lock.

13. The motor-vehicle lock as claimed in claim 2, wherein it is only the actuating lever being restored fully into the starting position which causes the latching action to be reversed and the crash element to be adjusted into the normal state.

14. The motor-vehicle lock as claimed in claim 5, wherein the crash-element axis is arranged at a distance from the actuating-lever axis.

15. The motor-vehicle lock as claimed in claim 14, wherein the crash-element axis can be displaced on the crash element, and wherein the adjustment of the crash element between the normal state and the crash state is attributable to a displacement of the crash-element axis on the crash element.

16. The motor-vehicle lock as claimed claim 1, wherein the switchable coupling comprises a guide-track coupling.

17. The motor-vehicle lock as claimed in claim 1, wherein one of the coupling elements is designed in the form of a guide track and the other of the coupling elements is designed in the form of a sliding block.

18. The motor-vehicle lock as claimed in claim 11, wherein one of the coupling elements has an undercut, and wherein the other one of the coupling elements engages behind the undercut in order for the two coupling elements to be latched to one another.

* * * * *